US011185968B2

(12) United States Patent
Shi et al.

(10) Patent No.: US 11,185,968 B2
(45) Date of Patent: Nov. 30, 2021

(54) QUICK FASTENING DEVICE

(71) Applicant: Xu Ying, Guangzhou (CN)

(72) Inventors: Zhaojun Shi, Guangzhou (CN); Canquan Huang, Guangzhou (CN); Jie Liu, Guangzhou (CN)

( * ) Notice: Subject to any disclaimer, the term of this patent is extended or adjusted under 35 U.S.C. 154(b) by 227 days.

(21) Appl. No.: 16/439,656

(22) Filed: Jun. 12, 2019

(65) Prior Publication Data

US 2020/0147774 A1 May 14, 2020

(30) Foreign Application Priority Data

Nov. 13, 2018 (CN) ..... 201811344450.7

(51) Int. Cl.
*B25C 1/04* (2006.01)
*B25C 7/00* (2006.01)

(52) U.S. Cl.
CPC ..... *B25C 1/047* (2013.01); *B25C 7/00* (2013.01)

(58) Field of Classification Search
CPC ..... B25D 11/12; B25D 11/125; B25C 1/047
USPC ..... 173/140, 216
See application file for complete search history.

(56) References Cited

U.S. PATENT DOCUMENTS 3,756,090 A * 9/1973 Melia ..... F16H 31/001 74/130
4,365,962 A * 12/1982 Regelsberger ..... B25D 16/003 173/104
6,520,266 B2 * 2/2003 Bongers-Ambrosius ..... B25D 11/12 173/115
7,191,847 B2 * 3/2007 Haas ..... B23D 51/16 173/114
7,708,083 B2 * 5/2010 Dresig ..... B25D 11/005 173/2
8,267,189 B2 * 9/2012 Manschitz ..... B25D 11/125 173/104
8,393,409 B2 * 3/2013 Pedicini ..... A61B 17/1604 173/201
8,757,285 B2 * 6/2014 Weber ..... B24B 23/04 173/49
8,887,831 B2 * 11/2014 Zhang ..... B25F 5/001 173/216
8,936,106 B2 * 1/2015 Pedicini ..... A61B 17/92 173/201
9,815,160 B2 * 11/2017 Nitsche ..... B25D 11/005
9,969,071 B2 * 5/2018 Nitsche ..... B25D 16/006
10,183,390 B2 * 1/2019 Wiedemann ..... B25D 16/003
10,328,558 B2 * 6/2019 Rompel ..... B25B 21/026
(Continued)

*Primary Examiner* — Gloria R Weeks

(57) ABSTRACT

A novel quick fastening device comprises a base, an energy storage medium, an impact unit and a driving mechanism; the driving mechanism includes an annular gear, a driving shaft, a crank, a planet gear; the planet gear is placed in the annular gear and engaging with the annular gear, so that it can implement revolution against annular gear, the planet gear implements rotation at the upper end of crank; a clamp shaft for connecting the impact unit is located in the upper end of the connecting rod, the lower end of driving shaft is connected to the rotating energy release unit; the annular gear-planet gear structure to implement the conversion of rotary motion into reciprocating motion, the kinematic trajectory of clamp shaft on the connecting rod approximates to a straight line, so as to reduce the kinetic friction force of load to the maximum extent to avoid wear.

9 Claims, 8 Drawing Sheets

(56) References Cited

U.S. PATENT DOCUMENTS

| | | | | |
|---|---|---|---|---|
| 10,342,591 | B2 * | 7/2019 | Pedicini | B25D 11/068 |
| 10,414,036 | B2 * | 9/2019 | Schaer | B25D 16/00 |
| 2007/0114050 | A1 * | 5/2007 | Baumann | B23B 45/008 173/216 |
| 2012/0036722 | A1 * | 2/2012 | Hittmann | B27B 17/08 30/216 |
| 2012/0151782 | A1 * | 6/2012 | Liaw | B23D 51/16 30/394 |
| 2012/0186842 | A1 * | 7/2012 | Wiedemann | B25D 16/003 173/48 |

* cited by examiner

QUICK FASTENING DEVICE

BACKGROUND OF INVENTION

1. Field of the Invention

The present invention relates generally to the technical field of machine tool products, and more particularly to a novel quick fastening device.

2. Description of Related Art

A quick fastening machine (e.g. a nailing gun) usually compresses the energy storage medium (e.g. gas, spring, rubber) to store energy, and then it is released quickly to apply work to the outside.

How to implement quick release after the driving mechanism compresses the energy storage medium becomes a difficulty in the design process of this kind of mechanical equipment.

In addition, the common driving mechanisms convert rotary motion into reciprocating motion, the structure is crank-connecting rod structure, but this structure has very large stress inclination in the course of motion, i.e. the angle of connecting rod, when the inclination is too large, the kinetic friction force of load (impact unit) increases, and the mechanism is worn, the product service life is affected.

In view of this, this inventor proposes the following technical proposal.

SUMMARY OF THE INVENTION

The purpose of the present invention is to overcome the deficiencies of the prior art and to provide a novel quick fastening device.

In order to solve the above technical problems, the present invention adopts the following technical solutions:

A novel quick fastening device, comprising:

a base, an energy storage medium, an impact unit connected to energy storage medium, and a driving mechanism installed in base for pushing the impact unit to compress the energy storage medium to store energy;

wherein the driving mechanism includes an annular gear fixed into the base, a driving shaft installed in the lower end of base, a crank installed on driving shaft, a planet gear rotatably installed in the upper end of crank and a rotatable connecting rod installed on planet gear; the planet gear is placed in the annular gear and engaging with the annular gear, so that it can implement revolution against annular gear, the planet gear implements rotation at the upper end of crank; a clamp shaft for connecting the impact unit is located in the upper end of the connecting rod, the lower end of the driving shaft extends out of the lower end of base and connects the rotating energy release unit.

More particularly, wherein the rotation angle of the planet gear is identical with revolution angle.

More particularly, wherein the ratio of the reference diameter D1 of the annular gear to the reference diameter D2 of planet gear is 2:1.

More particularly, the novel quick fastening device further includes a disengaging component for disengaging the impact unit from the clamp shaft.

More particularly, wherein the disengaging component includes a first shaft installed on the base and a disengaging block installed in the upper end of the first shaft; alternatively, the disengaging component includes a first shaft installed on the base and a disengaging block fixed to the upper end of the first shaft.

More particularly, wherein the upper end of the planet gear is formed with an interconnecting piece, and an end of the interconnecting piece has a first axle hole; the lower end face of the connecting rod is formed with a first axle body opposite to the other end of the clamp shaft, and the first axle body is inserted into the first axle hole.

More particularly, the novel quick fastening device further includes a reset unit for resetting the connecting rod, wherein the reset unit is any one of elastic rubber, spring and magnetic elements, one end of the reset unit is propped against or connected to the connecting rod, the other end of the reset unit is fixed to the base or planet gear.

More particularly, wherein the reset unit is an elastic rubber, one end of the elastic rubber is fixed to a hook part located at the side of the connecting rod, the other end of the elastic rubber is fixed to the base by a holder, and the base is provided with a second shaft and a tensioner installed in the upper end of the second shaft, the elastic rubber passes by the tensioner.

More particularly, wherein the impact unit is an impact bar, a slot is located in the side of the impact bar, the clamp shaft is placed in the slot; alternatively, a bulge is located at the side of the impact bar, the clamp shaft props the bulge.

More particularly, wherein the planet gear includes a bearing disposed therein, the bearing is fixed to the end of crank by bolt; a shaft sleeve is fitted over the clamp shaft.

In comparison to the existing technology, the present invention has the following effects. The present invention uses the annular gear-planet gear structure to implement the conversion of rotary motion into reciprocating motion, the rotating energy output unit drives the driving shaft to rotate anticlockwise, the planet gear revolves in the annular gear, and the planet gear rotates against the crank, the connecting rod can rotate against the planet gear, so as to make sure the kinematic trajectory of clamp shaft on the connecting rod approximates to a straight line, the kinetic friction force of load is reduced to the maximum extent to avoid wear, the stability and smoothness of impact unit operation are guaranteed, the work quality is upgraded, so the present invention has a very strong marketability.

DETAILED DESCRIPTION OF THE INVENTION

Figure 1:
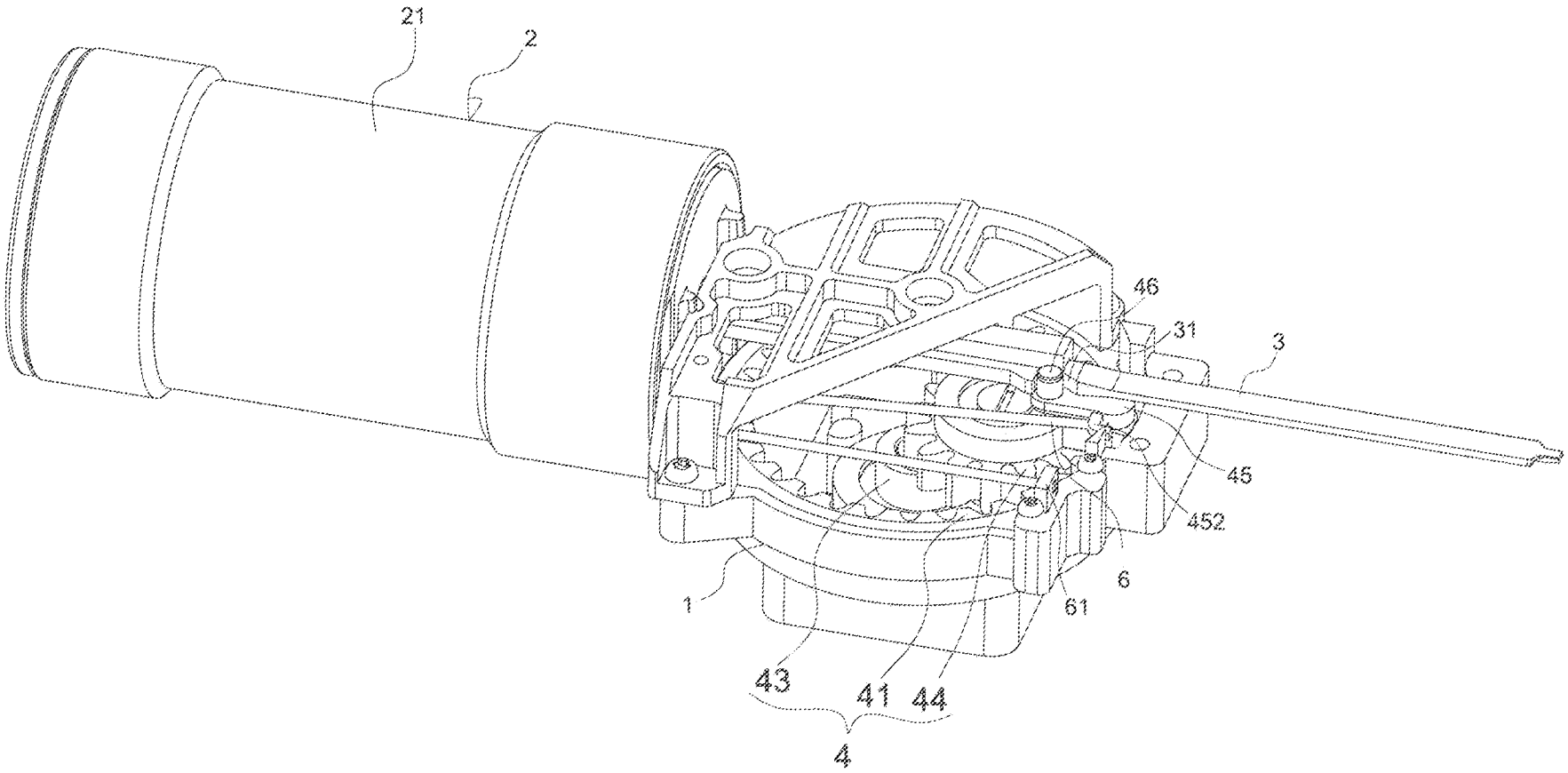
FIG. 1 is a stereogram of the present invention.
Figure 2:
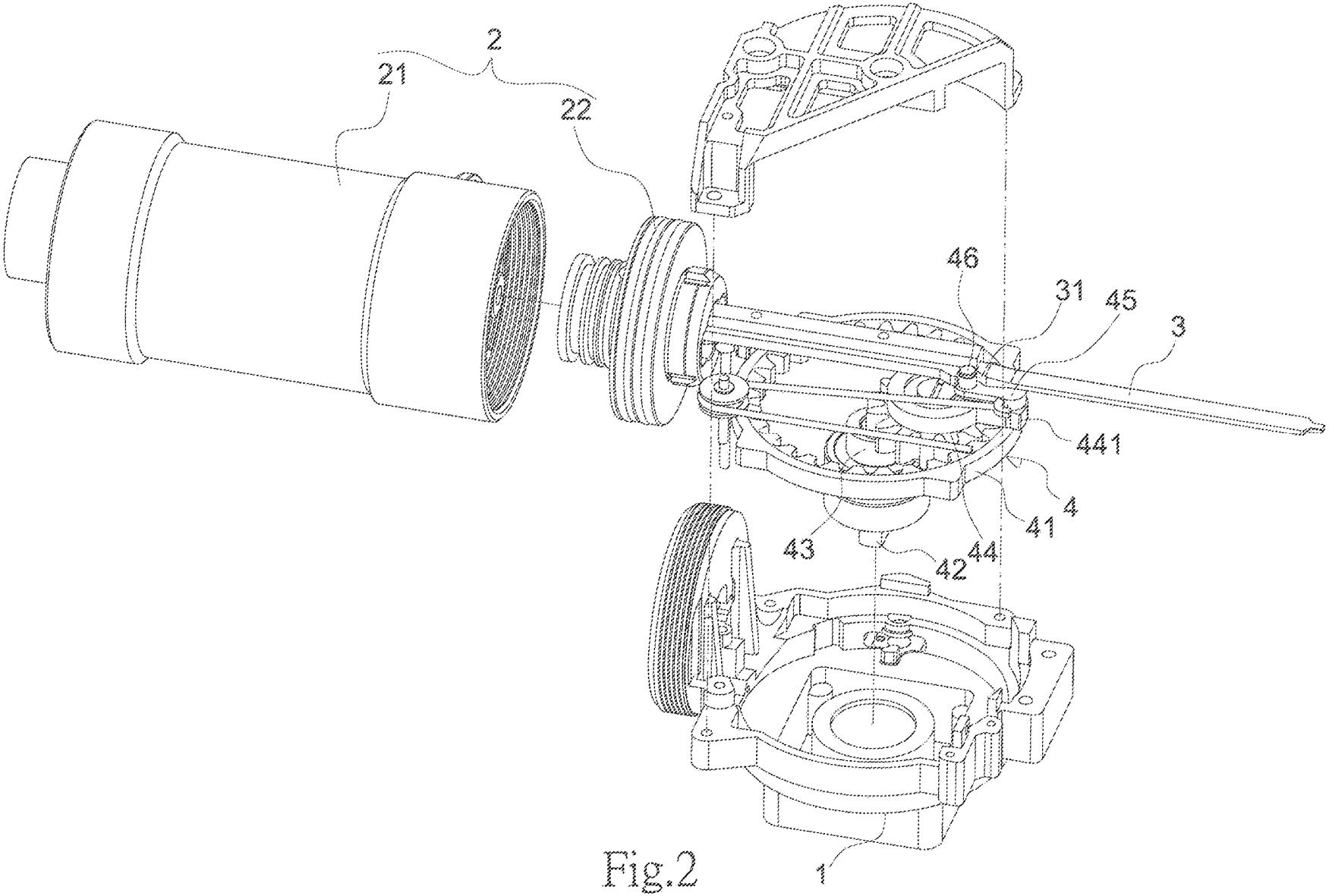
FIG. 2 is a three-dimensional exploded diagram of the present invention.
Figure 3:
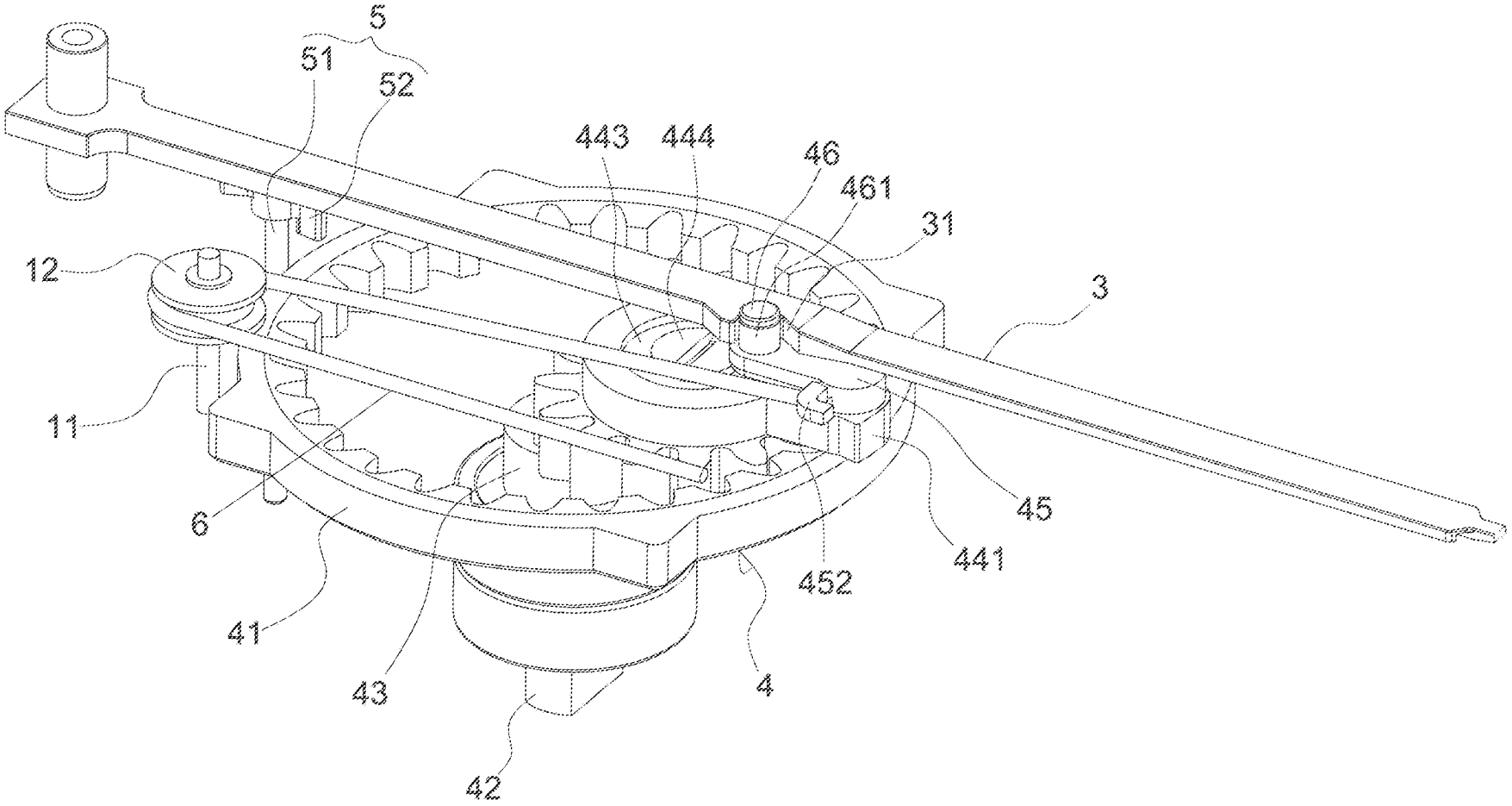
FIG. 3 is an assembly drawing of driving mechanism and impact unit in the present invention.
Figure 4:
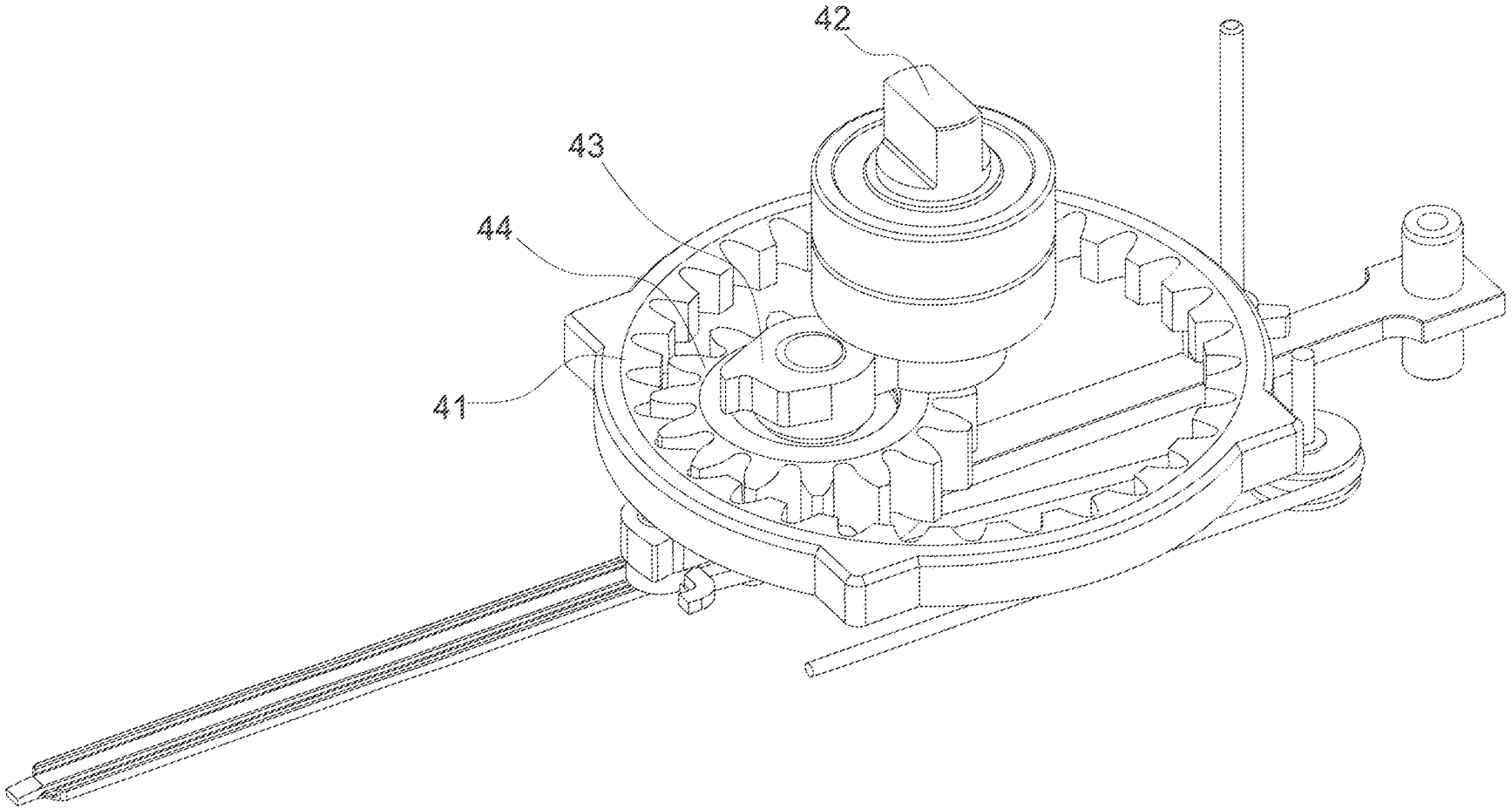
FIG. 4 is an assembly drawing from another view angle of driving mechanism and impact unit in the present invention.
Figure 5:
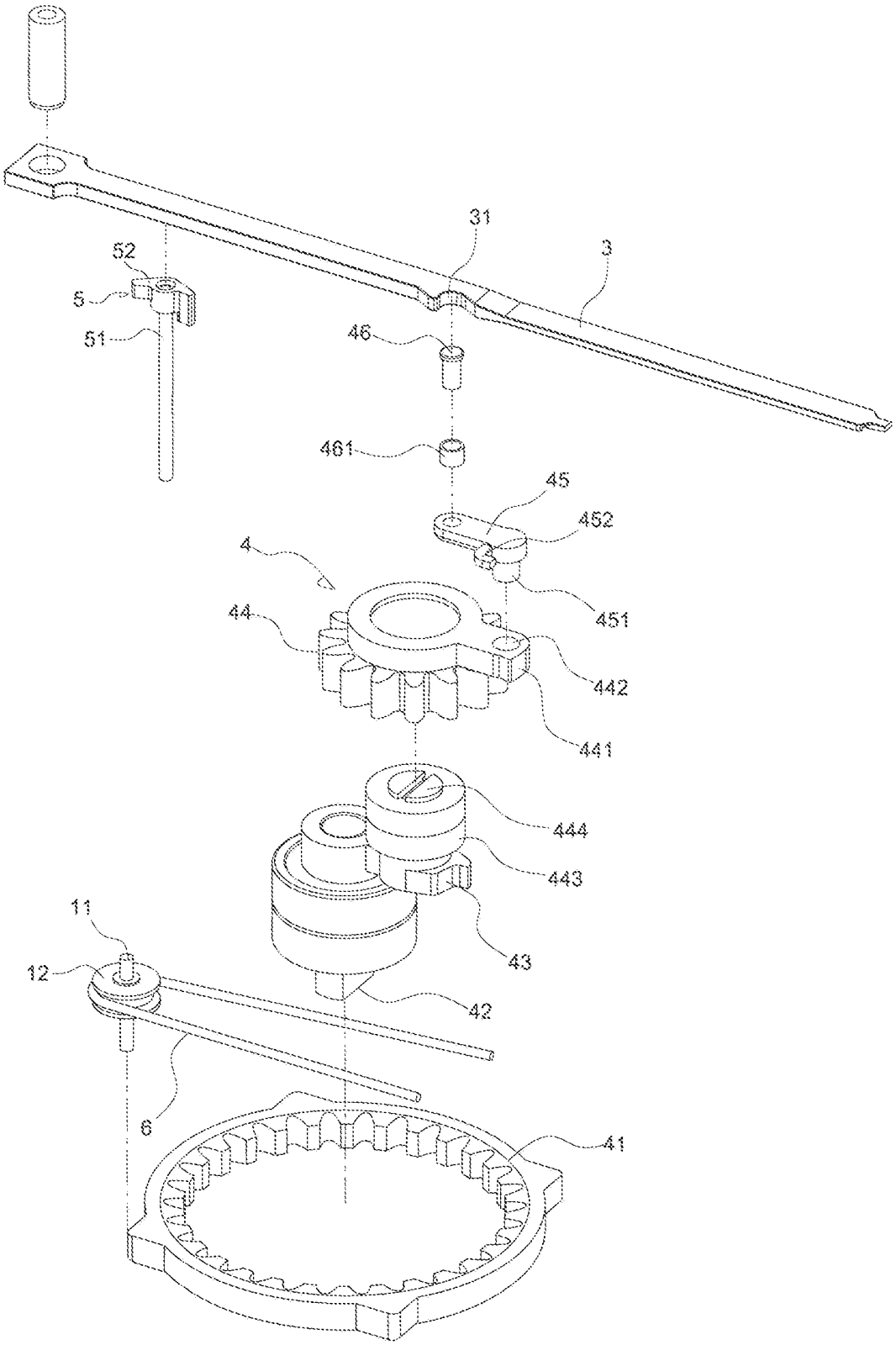
FIG. 5 is an exploded view of FIG. 3.

FIGS. 1-8 and 10 show a novel quick fastening device, which comprises a base 1, an energy storage medium 2 installed on base 1, an impact unit 3 connected to energy storage medium 2, and a driving mechanism 4 installed in base 1 for pushing the impact unit 3 to compress the energy storage medium 2 to store energy.

Said energy storage medium 2 is compressed to store energy, and then the energy is released to apply work to the outside, impelling the impact unit 3 to implement impact work.

Said energy storage medium is any medium which can be compressed to store energy and can expand to apply work to the outside, e.g. gas, spring, rubber and different elastic bodies. In this embodiment, the energy storage medium 2 comprises a cylinder body 21 and the air stored in the cylinder, the impact unit 3 is connected to the piston in said cylinder body 21. When the driving mechanism 4 drives the impact unit 3 to move towards the cylinder body 21, the piston moves inward to compress the gas in the cylinder body 21 to store energy. When the impact unit 3 is disengaged from the driving mechanism 4, the energy stored in the cylinder body 21 is released to impel the impact unit 3 to impact outwards rapidly.

Said driving mechanism 4 is a mechanism which can convert rotary motion into rectilinear motion, so as to drive the impact unit to compress the energy storage medium. To be specific, said driving mechanism 4 comprises an annular gear 41 fixed into base 1, a driving shaft 42 installed in the lower end of base 1, a crank 43 installed on driving shaft 42, a planet gear 44 rotatably installed in the upper end of crank 43 and a rotatable connecting rod 45 installed on planet gear 44. The planet gear 44 is located in the annular gear 41 and engaging with the annular gear 41, so as to implement revolution against annular gear 41. The planet gear 44 implements rotation at the upper end of crank 43. The upper end of said connecting rod 45 is provided with a clamp shaft 46 for connecting the impact unit 3. The lower end of said driving shaft 42 extends out of the lower end of base 1 and connects the rotating energy release unit. The rotating energy release unit transfers the output work to the driving mechanism, it is usually connected to the reducer casing or prime mover to transfer output work, which is to say, the rotating energy release unit can drive the driving shaft 42 to rotate. In the operation of said driving mechanism 4, the rotating energy release unit drives said driving shaft 42 to rotate anticlockwise. The planet gear 44 implements revolution in the annular gear 41, and the planet gear 44 implements rotation against crank 43. The connecting rod 45 can rotate against planet gear 44, so as to make sure the kinematic trajectory of clamp shaft 46 on the connecting rod 45 approximates to a straight line, the kinetic friction force of load is reduced to the maximum extent to avoid wear, the operational stability and smoothness of impact unit 3 are guaranteed, the work quality is upgraded, so the present invention has a very strong marketability.

Figure 6:
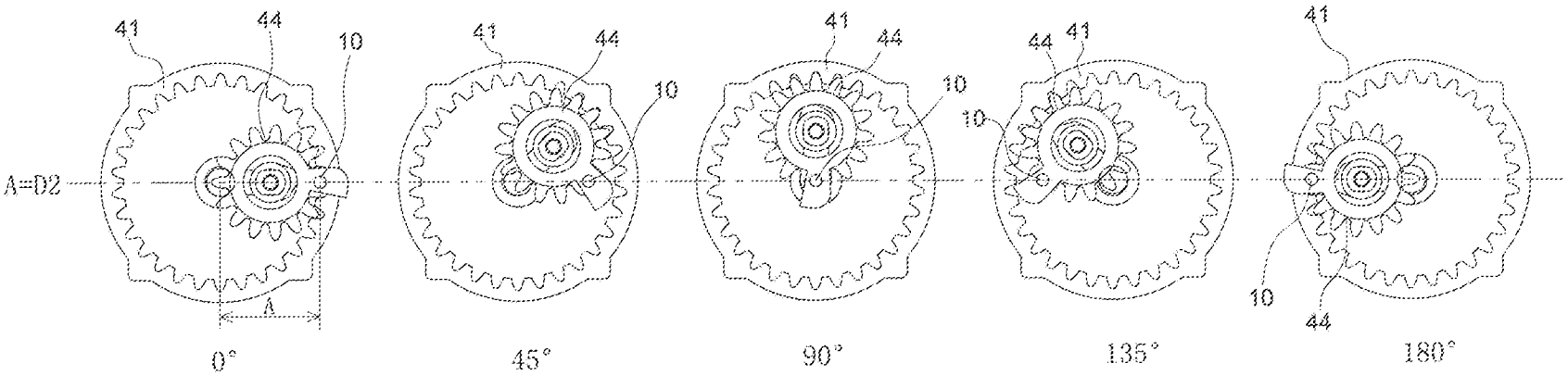
FIG. 6 is an running state diagram 1 of planet gear and annular gear in the present invention.
Figure 7:
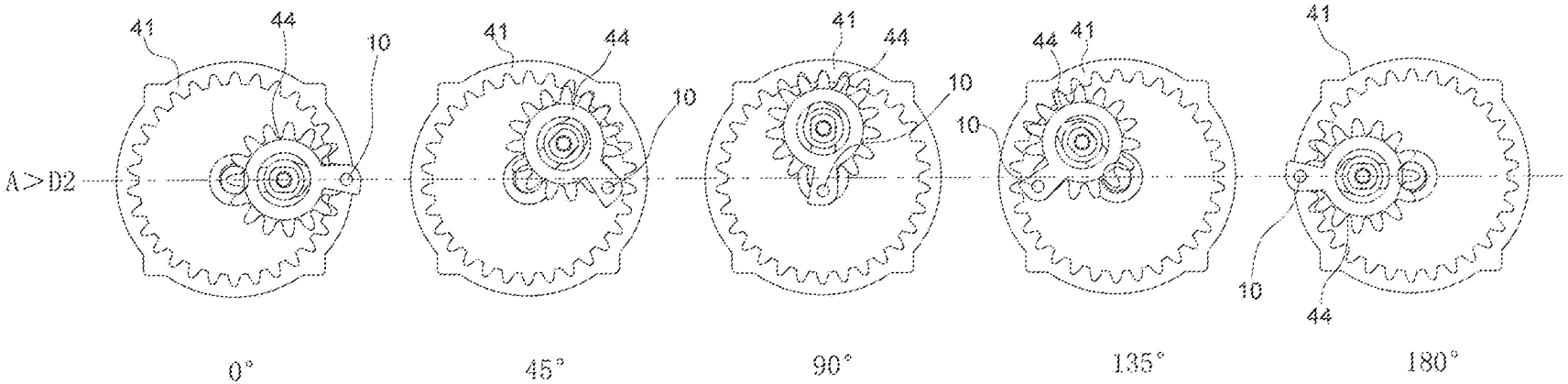
FIG. 7 is a running state diagram 2 of planet gear and annular gear in the present invention.
Figure 8:
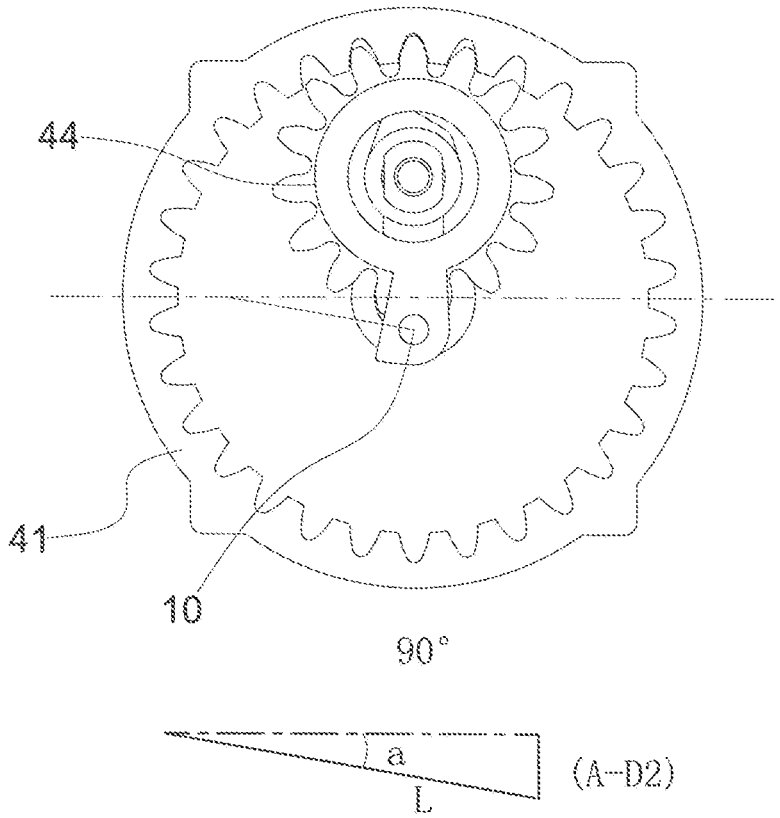
FIG. 8 is an assembly drawing of planet gear and annular gear in the present invention.
Figure 9:
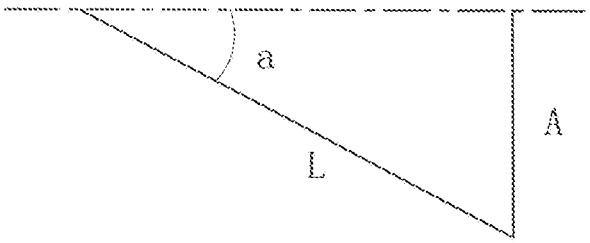
FIG. 9 is a schematic diagram of the maximum tilt angle of connecting rod of conventional crank and connecting rod structure.

The gear ratio of said annular gear 41 to planet gear 44 is 2:1. The rotation angle of said planet gear is identical with the revolution angle. The ratio of the reference diameter D1 of said annular gear to the reference diameter D2 of planet gear is 2:1. Thus, when the crank rotates 180° from the lower dead point to the upper dead point, the planet gear has rotated 360° against the annular gear, the revolution trajectory of planet gear is a 180° circular arc, so in relation to the base, the planet gear has rotated 360°−180°=180°, when the crank rotates 360°, the planet gear also rotates 360° against the base, the mechanism returns to the origin. The connecting rod and planet gear are linked with the hinge point O 10, the distance from the point O 10 to the crank rotation center is A. As shown in FIG. 6, when the crank is at the lower dead point, A=D2, the kinematic trajectory of point O 10 is a straight line. As shown in FIG. 7, when A>D2 or A<D2, the kinematic trajectory of point O 10 is approximately elliptical. As shown in FIG. 8, the connecting rod length is set as L, the maximum tilt angle a=arcsin((A−D2)/L). As shown in FIG. 9, the maximum tilt angle of connecting rod of conventional crank and connecting rod structure is a=arcsin(A/L). It is obvious that the annular gear and planet gear structure used in the present invention can reduce the connecting rod tilt angle a greatly.

The present invention has a disengaging component 5 for disengaging the impact unit 3 from said clamp shaft 46. To be specific, said disengaging component 5 comprises a first shaft 51 installed on said base 1 and a disengaging block 52 installed in the upper end of the first shaft 51; or said disengaging component 5 comprises a first shaft 51 installed on said base 1 and a disengaging block 52 fixed to the upper end of the first shaft 51. When the planet gear 44 rotates to the lateral side of disengaging block 52, the disengaging block 52 contacts the connecting rod 45, and stops the connecting rod 45, meanwhile the disengaging block 52 rotates an angle, so that the disengaging block 52 contacts the connecting rod 45, after the connecting rod 45 is disengaged from the impact unit 3, the planet gear 4 and connecting rod 45 continue rotating to go over the disengaging block 52. At this point, the impact unit 3 impacts quickly to finish the impact work.

A bearing 443 is located in said planet gear 44, the bearing 443 is fixed to the end of crank 43 by bolt 444, so that the planet gear 44 can rotate against crank 43.

An interconnecting piece 441 is formed at the upper end of said planet gear 44, a first axle hole 442 is located in the end of the interconnecting piece 441; a first axle body 451 is formed on the lower end face of said connecting rod 45 opposite to the other end equipped with clamp shaft 46, the first axle body 451 is inserted in the first axle hole 442, so that the connecting rod 45 can rotate against the planet gear 44. A shaft sleeve 461 is fitted over said clamp shaft 46.

The present invention has a reset unit for resetting the connecting rod 45. The reset unit is any one of elastic rubber, spring and magnetic elements. One end of the reset unit is propped against or connected to said connecting rod 45. The other end of the reset unit is fixed to base 1 or planet gear 44. To be specific, said reset unit is an elastic rubber 6, one end of the elastic rubber 6 is fixed to a hook part 452 located on the side of said connecting rod 45, the other end of the elastic rubber 6 is fixed to the base 1 by a holder 61, and the base 1 is provided with a second shaft 11 and a tensioner 12 installed in the upper end of the second shaft 11. Said elastic rubber 6 passes by the tensioner 12. Alternatively, said reset unit is a spring, one end of the spring props said connecting rod 45, the other end is fixed to the planet gear 44.

Said impact unit 3 is an impact bar, a slot 31 is located in the side of the impact bar, said clamp shaft 46 is placed in the slot 31; alternatively, a bulge is located at the side of the impact bar, said clamp shaft 46 props the bulge. As the preferred embodiment, the following structure is used: said impact unit 3 is an impact bar, a slot 31 is located in the side of the impact bar, said clamp shaft 46 is placed in the slot 31 for clamping, and the slot 31 is tilted, so that the clamp shaft 46 withdraws from the slot 31 quickly under the effect of disengaging component 5.

Figure 10:
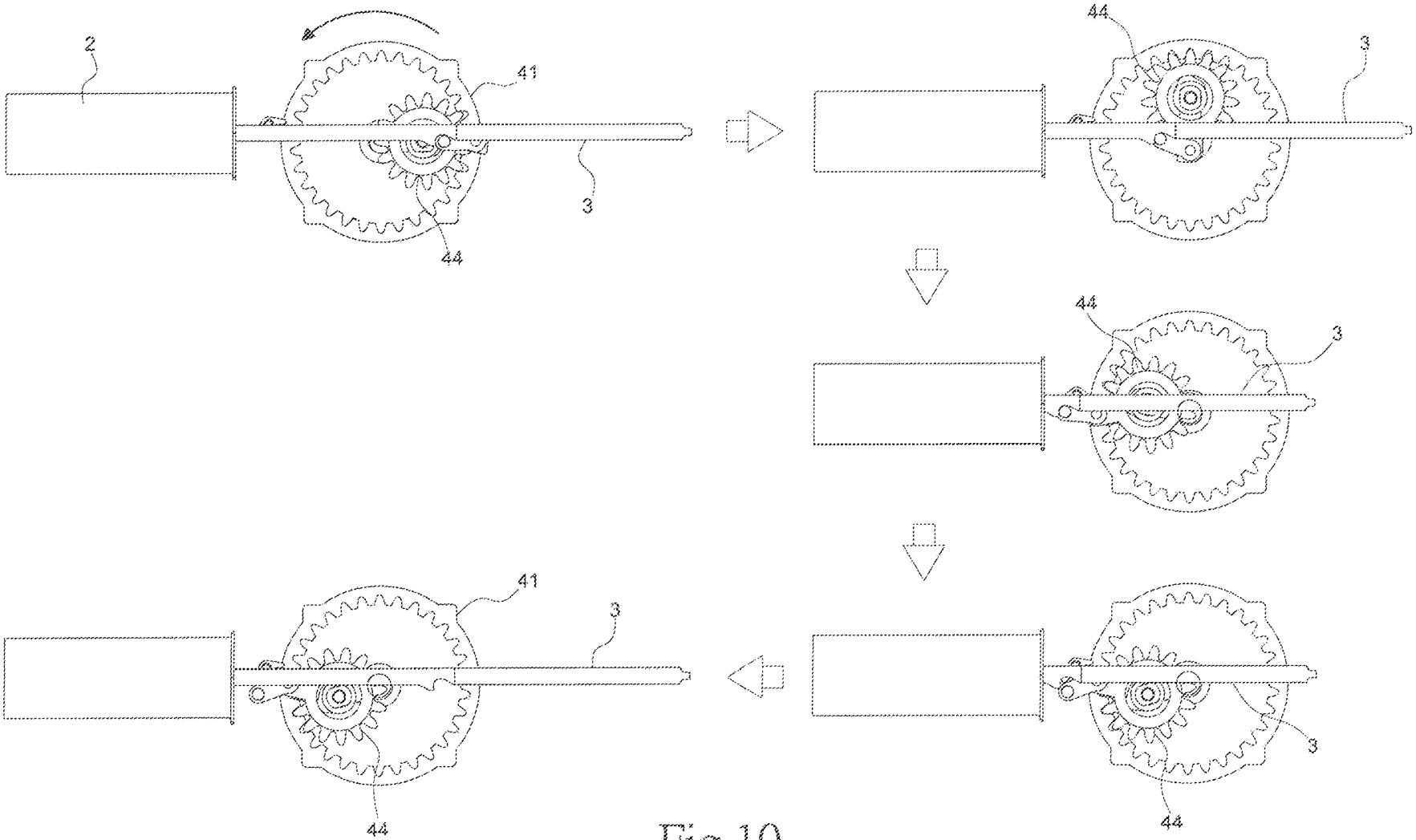
FIG. 10 shows the operating principle of the present invention.

As shown in FIG. 10, the working procedure of the present invention is described below, nearby the lower dead point of crank (State 1), the connecting rod and impact unit are mechanically engaged. As the rotation continues, from State 1 to State 4, the connecting rod drives the impact unit to compress the energy storage medium to store energy. When the crank reaches the upper dead point (State 4), the driving mechanism pushes the disengaging component, the disengaging component pushes the connecting rod, the connecting rod is disengaged from the impact unit. Referring to State 5, when the connecting rod is disengaged from the impact unit, the impact unit applies work to the outside under the thrust of energy storage medium. When the output shaft continues rotating to State 1, a cycle is completed, the starting point of this cycle is not limited to State 1.

To sum up, the present invention uses the annular gear-planet gear structure to implement the conversion of rotary motion into reciprocating motion, the rotating energy release unit drives said driving shaft 42 to rotate anticlockwise, the planet gear 44 implement revolution in the annular gear 41, and the planet gear 44 implements rotation against the crank 43, the connecting rod 45 can rotate against the planet gear 44, so as to make sure the kinematic trajectory of clamp shaft 46 on the connecting rod 45 approximates to a straight line, the kinetic friction force of load is reduced to the maximum extent to avoid wear, the operational stability and smoothness of impact unit 3 are guaranteed, the work quality is upgraded, so the present invention has a very strong marketability.

We claim:

1. A novel quick fastening device, comprising:

a base (1), an energy storage medium (2), an impact unit (3) connected to energy storage medium (2), and a driving mechanism (4) installed in base (1) for pushing the impact unit (3) to compress the energy storage medium (2) to store energy;

wherein the driving mechanism (4) includes an annular gear (41) fixed into the base (1), a driving shaft (42) installed in the lower end of base (1), a crank (43) installed on driving shaft (42), a planet gear (44) rotatably installed in the upper end of crank (43) and a rotatable connecting rod (45) installed on planet gear (44); the planet gear (44) is placed in the annular gear (41) and engaging with the annular gear (41), so that it can implement revolution against annular gear (41), the planet gear (44) implements rotation at the upper end of crank (43); a clamp shaft (46) for connecting the impact unit (3) is located in the upper end of the connecting rod (45), the lower end of the driving shaft (42) extends out of the lower end of base (1);

wherein the novel quick fastening device includes a disengaging component (5) for disengaging the impact unit (3) from the clamp shaft (46).

2. The novel quick fastening device defined in claim 1, wherein the rotation angle of the planet gear is identical with revolution angle.

3. The novel quick fastening device defined in claim 1, wherein the ratio of the reference diameter D1 of the annular gear to the reference diameter D2 of planet gear is 2:1.

4. The novel quick fastening device defined in claim 1, wherein the disengaging component (5) includes a first shaft (51) installed on the base (1) and a disengaging block (52) installed in the upper end of the first shaft (51); alternatively, the disengaging component (5) includes a first shaft (51) installed on the base (1) and a disengaging block (52) fixed to the upper end of the first shaft (51).

5. The novel quick fastening device defined in claim 1, wherein the upper end of the planet gear (44) is formed with an interconnecting piece (441), and an end of the interconnecting piece (441) has a first axle hole (442); the lower end face of the connecting rod (45) is formed with a first axle body (451) opposite to the other end of the clamp shaft (46), and the first axle body (451) is inserted into the first axle hole (442).

6. The novel quick fastening device defined in claim 1 further includes a reset unit for resetting the connecting rod (45), wherein the reset unit is any one of elastic rubber, spring and magnetic elements, one end of the reset unit is propped against or connected to the connecting rod (45), the other end of the reset unit is fixed to the base (1) or planet gear (44).

7. The novel quick fastening device defined in claim 6, wherein the reset unit is an elastic rubber (6), one end of the elastic rubber (6) is fixed to a hook part (452) located at the side of the connecting rod (45), the other end of the elastic rubber (6) is fixed to the base (1) by a holder (61), and the base (1) is provided with a second shaft (11) and a tensioner (12) installed in the upper end of the second shaft (11), the elastic rubber (6) passes by the tensioner (12).

8. The novel quick fastening device defined in claim 1, wherein the impact unit (3) is an impact bar, a slot (31) is located in the side of the impact bar, the clamp shaft (46) is placed in the slot (31); alternatively, a bulge is located at the side of the impact bar, the clamp shaft (46) props the bulge.

9. The novel quick fastening device defined in claim 1, wherein the planet gear (44) includes a bearing (443) disposed therein, the bearing (443) is fixed to the end of crank (43) by bolt (444); a shaft sleeve (461) is fitted over the clamp shaft (46).

* * * * *